US007174761B2

(12) United States Patent
Iwamoto et al.

(10) Patent No.: US 7,174,761 B2
(45) Date of Patent: Feb. 13, 2007

(54) METHOD OF MANUFACTURING A SEAMLESS PIPE

(75) Inventors: Hiroyuki Iwamoto, Mita (JP); Akihito Yamane, Amagasaki (JP); Tooru Egoshi, Kainan (JP); Kenichi Sasaki, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/232,853

(22) Filed: Sep. 23, 2005

(65) Prior Publication Data

US 2006/0059969 A1 Mar. 23, 2006

Related U.S. Application Data

(63) Continuation of application No. PCT/JP2004/004193, filed on Mar. 25, 2004.

(30) Foreign Application Priority Data

Mar. 26, 2003 (JP) ..... 2003-086073

(51) Int. Cl.
*B21B 13/12* (2006.01)

(52) U.S. Cl. ..... 72/235; 72/208; 72/234; 72/370.01; 72/367.1

(58) Field of Classification Search ..... 72/252.5, 72/224, 225, 208, 209, 235, 234, 370.01, 72/367.1

See application file for complete search history.

(56) References Cited

U.S. PATENT DOCUMENTS

| | | | | | |
|---|---|---|---|---|---|
| 4,567,744 | A | * | 2/1986 | Yoshiwara et al. | 72/68 |
| 5,513,511 | A | * | 5/1996 | Imae et al. | 72/208 |
| 5,657,659 | A | * | 8/1997 | Yamada | 72/208 |

FOREIGN PATENT DOCUMENTS

| | | | | |
|---|---|---|---|---|
| JP | 01284411 | A | * | 11/1989 |
| JP | 07246415 | A | * | 9/1995 |
| JP | 2001293503 | A | * | 10/2001 |
| JP | 2002-001408 | | | 1/2002 |
| JP | 2002-035817 | | | 2/2002 |
| JP | 2002035818 | A | * | 2/2002 |

* cited by examiner

*Primary Examiner*—Dmitry Suhol
(74) *Attorney, Agent, or Firm*—Clark & Brody

(57) ABSTRACT

When manufacturing a seamless pipe by carrying out elongation rolling and sizing on a mother tube for forming a seamless pipe, the occurrence of portions of thickness variation in the seamless pipe is suppressed by previously identifying the portions of wall thickness variation where the thickness varies in the circumferential direction of the seamless pipe, and carrying out elongation rolling so that the thickness of the portions of the mother tube corresponding to the portions of wall thickness variation of the seamless pipe are different in thickness at the completion of elongation rolling from that of other portions of the mother tube. As a result, local variations in wall thickness in the circumferential direction of a seamless pipe are prevented.

6 Claims, 2 Drawing Sheets

METHOD OF MANUFACTURING A SEAMLESS PIPE

CROSS-REFERENCE TO RELATED APPLICATIONS

This application is a continuation of International Patent Application No. PCT/JP2004/004193, filed Mar. 25, 2004. This PCT application was not in English as published under PCT Article 21(2).

TECHNICAL FIELD

This invention relates to a method of manufacturing a seamless pipe. Specifically, the present invention relates to a method of manufacturing a seamless pipe which can prevent local variations in the wall thickness of a seamless pipe in the circumferential direction.

BACKGROUND ART

FIG. 1 is a simplified explanatory view showing an example of a conventional process 1 for manufacturing a seamless pipe such as a seamless steel pipe. In this process 1, a rod-shaped billet is pierced in a piercing mill (both not shown) to form a rough pipe (hollow shell) 4.

The hollow shell 4 undergoes elongation rolling using a mandrel mill 2 which has rolling stands 2*a*–2*c* equipped with caliber rolls and which reduces the wall thickness of the hollow shell 4 between the caliber rolls and a mandrel bar 5. Sizing is then performed using a sizing mill 3 having rolling stands 3*a*–3*c* equipped with three caliber rolls installed at equal intervals of 120° in the circumferential direction. In this manner, a seamless pipe having a prescribed outer diameter and wall thickness is manufactured.

The seamless pipe which has undergone sizing has thickness variations where its wall thickness locally varies in the circumferential direction of the pipe. There is a prescribed standard for the allowable extent of the thickness variation in a product. Up to the present time, in order to satisfy the standard, in the mandrel mill 2, thickness variations caused only by elongation rolling in the mandrel mill 2 were suppressed, and in the sizing mill 3, thickness variations caused only by sizing in the sizing mill 3 were suppressed. Namely, in the past, elongation rolling of hollow shell 4 was carried out so that thickness variations did not occur at the completion of elongation rolling. The resulting rough pipe (mother tube) 4 was placed into a reheating furnace 6, and after heating to a uniform temperature so as not to produce thickness variations during sizing, sizing was carried out with a sizing mill 3 (see the heating steps shown by dashed arrows in FIG. 1).

In recent years, with the object of improving productivity, as shown by the solid arrows in FIG. 1, sizing has come to be carried out by a sizing mill 3 on a mother tube 4 which has undergone elongation rolling in a mandrel mill 2 immediately after the completion of elongation rolling without performing heating in a reheating furnace 6. However, if heating in a reheating furnace 6 is not performed, the temperature distribution in the circumferential direction of the mother tube 4 which is introduced into the sizing mill 3 becomes nonuniform for the following reasons (a)–(c).

(a) The portion of the mother tube 4 which is reduced by the last rolling stand 2*c* of the mandrel mill 2 is transported from the mandrel mill 2 with the mandrel bar 5 still inserted into the interior of the mother tube 4, and then the mandrel bar 5 is pulled out of the mother tube 4. During this period, the heat of the mother tube 4 is transferred to the mandrel bar 5, so the temperature of the portion of the mother tube 4 which is reduced in the last stand 2*c* is lower than the temperature of other portions of the mother tube 4. The decrease in temperature increases as the length of time from when the elongation rolling by the mandrel mill 2 is completed until when the mandrel bar 5 is pulled out of the mother tube 4 increases.

(b) As shown in FIG. 1, with an ordinary two-roll mandrel mill, the pairs of caliber rolls in each rolling stand 2*a*–2*c* are arranged in series with the reduction direction varying by 90° between each pair. With this arrangement, at the portions of the mother tube 4 located at 45°, measured from the axis of the mother tube 4, with respect to the direction of reduction of the caliber rollers, the outer surface of the mother tube 4 contacts the caliber rolls in each stand and the corresponding inner surface contacts the mandrel bar 5. Therefore, the decrease in temperature of the outer and inner surfaces of these portions of the mother tube 4 located at 45° with respect to the direction of reduction becomes markedly greater than the decrease in the temperature of the outer and inner surface of other portions of the mother tube.

(c) When the number of even numbered rolling stands of the mandrel mill 2 (rolling stand 2*b* in the illustrated example) is different from the number of odd numbered rolling stands (rolling stands 2*a* and 2*c* in the illustrated example) or when the reduction which is carried out is not the same for each of rolling stands 2*a*–2*c*, a temperature difference develops in the mother tube 4 in the direction of reduction.

In the sizing mill 3, since a reduction in the outer diameter of the mother tube 4 is produced without using a mandrel bar to restrain the inner surface of the mother tube 4, the wall thickness of the mother tube 4 typically increases during sizing. In particular, portions of the mother tube 4 having a high temperature undergo a larger increase in wall thickness than portions at a low temperature due to having a lower resistance to deformation. Therefore, variations in thickness in which the wall thickness locally varies in the circumferential direction are produced in a seamless pipe during sizing. As a result, at the completion of sizing, the wall thickness of portions which contact the caliber rolls of the last rolling stand 2*c* of the mandrel mill 2 and the wall thickness of portions spaced from the direction of reduction by 45° are thinner than the wall thickness of other portions.

Japanese Published Unexamined Patent Application Hei 1-284411 (referred to below as Patent Document 1) discloses an invention in which thickness variations caused by elongation rolling of a seamless pipe are suppressed by forming grooves in the surface of the caliber rolls of a mandrel mill in order to cancel local decreases in thickness.

DISCLOSURE OF THE INVENTION

However, the extent of the local decreases in thickness, i.e., the amount of the decreases in thickness varies with the operating conditions, so it is not constant. Accordingly, even if elongation rolling is performed using caliber rolls having grooves formed in their surfaces for canceling reduced thickness portions as in the invention disclosed in Patent Document 1, when the amount of reduction in thickness of the reduced thickness portions is different from the estimated amount, the grooves cannot completely cancel the reduced thickness portions and so cannot eliminate variations in thickness.

If a plurality of caliber rolls having grooves of different depths are prepared and caliber rolls having grooves with a suitable depth corresponding to the amount of decrease in thickness are installed in a rolling mill, it is possible to eliminate thickness variations. However, in this case it becomes necessary to prepare a large number of caliber rolls having grooves of different depths, so an increase in costs is unavoidable. In addition, the time required for replacing the caliber rolls greatly increases, so the productivity of a manufacturing process for seamless pipes ends up greatly decreasing. Therefore, this method is not suitable for actual production.

Furthermore, when the invention disclosed in Patent Document 1 is carried out, metal flow in the circumferential direction of a mother tube 4 is greatly impeded by the grooves formed in the surfaces of the caliber rolls. Therefore, seizing of the caliber rolls and surface flaws in the product can easily occur.

The object of the present invention is to provide a method of manufacturing a seamless pipe which can prevent local variations in wall thickness in the circumferential direction with certainty.

The present invention is based on an extremely creative technical concept of preventing local variations in the wall thickness of a seamless pipe with certainty by intentionally producing thickness variations in a mother tube during elongation rolling. The present invention is a method of manufacturing a seamless pipe in which a mother tube successively undergoes elongation rolling and sizing, characterized in that thickness variations for canceling thickness variations in the circumferential direction of a seamless pipe produced by the sizing are formed in the circumferential direction of the mother tube during the elongation rolling.

Specifically, the present invention is a method of manufacturing a seamless pipe in which a mother tube is successively subjected to elongation rolling and sizing characterized in that portions of wall thickness variation of the seamless pipe where the thickness varies in the circumferential direction of the seamless pipe are determined in advance, and elongation rolling is carried out such that the thickness at the completion of elongation rolling of portions of the mother tube corresponding to the portions of wall thickness variation of the seamless pipe are different from the thickness of other portions of the mother tube, whereby the occurrence of portions of wall thickness variation in a product in the form of a seamless pipe are suppressed.

In a manufacturing method for a seamless pipe according to the present invention, "portions of wall thickness variation" means portions where the wall thickness varies by at least a prescribed suitably determined % (such as 1%) with respect to the average wall thickness of a transverse cross section of the seamless pipe, i.e., the average value of measurements of wall thickness at plural points in the circumferential direction of the seamless pipe.

When the wall thickness of a portion is thinner than the average, it is determined that the portion is a thin portion. When the wall thickness is larger than the average, it is determined that the portion is a thick portion.

In a manufacturing method for a seamless pipe according to the present invention, when a thin portion occurs in a seamless pipe, elongation rolling is preferably carried out such that the wall thickness of a portion of a mother tube corresponding to the thin portion is made thicker than the wall thickness of other portions of the mother tube at the completion of the elongation rolling. On the other hand, when a thick portion occurs in a seamless pipe, elongation rolling is preferably carried out such that the wall thickness of the thick portion is made thinner than the wall thickness of other portions of the mother tube at the completion of the elongation rolling.

In a manufacturing method for a seamless pipe according to the present invention, when a portion of wall thickness variation of a mother tube includes a position at 45°, measured from the axis of the pipe, with respect to the direction of reduction and is a thin portion, the elongation rolling is preferably carried out with the roll gaps of the rolling mill smaller than the gaps at which the shape of the grooves in the rolls is a circle, and using a mandrel bar having a smaller outer diameter than the outer diameter of a mandrel bar which can achieve a target wall thickness of a mother tube at the completion of the elongation rolling when the roll gaps are such that the shape of the roll grooves is a circle.

Furthermore, in a manufacturing method for a seamless pipe according to the present invention, when a portion of wall thickness variation of a mother tube at the completion of the elongation rolling includes a position in the direction of reduction of the final stand for carrying out elongation rolling and is a thin portion, the elongation rolling is preferably carried out such that the roll gap of the final stand of the rolling mill is larger than the gap at which the shape of the roll grooves is a circle, and the gap in the direction of reduction of the rolling stand before the final stand is smaller than the gap at which the shape of the grooves is a circle.

In this specification, "the shape of the roll grooves is a circle" means "two times the reciprocal of the distance between the bottom portions of the grooves of a pair of opposing caliber rolls is equal to the curvature of the bottom portion of the groove of each caliber roll".

MODES FOR CARRYING OUT THE INVENTION

[First Mode for Carrying Out the Invention]

A mode for carrying out a manufacturing method for a seamless pipe according to the present invention will be described in detail while referring to the accompanying drawings. In the following explanation, the seamless pipe is a seamless steel pipe, elongation rolling is carried out using a mandrel mill having rolling stands equipped with two caliber rolls positioned at intervals of 180°, and sizing is carried out using a sizing mill having rolling stands equipped with three caliber rolls disposed at intervals of 120°.

[Specifying Portions of Wall Thickness Variation]

Figure 1:
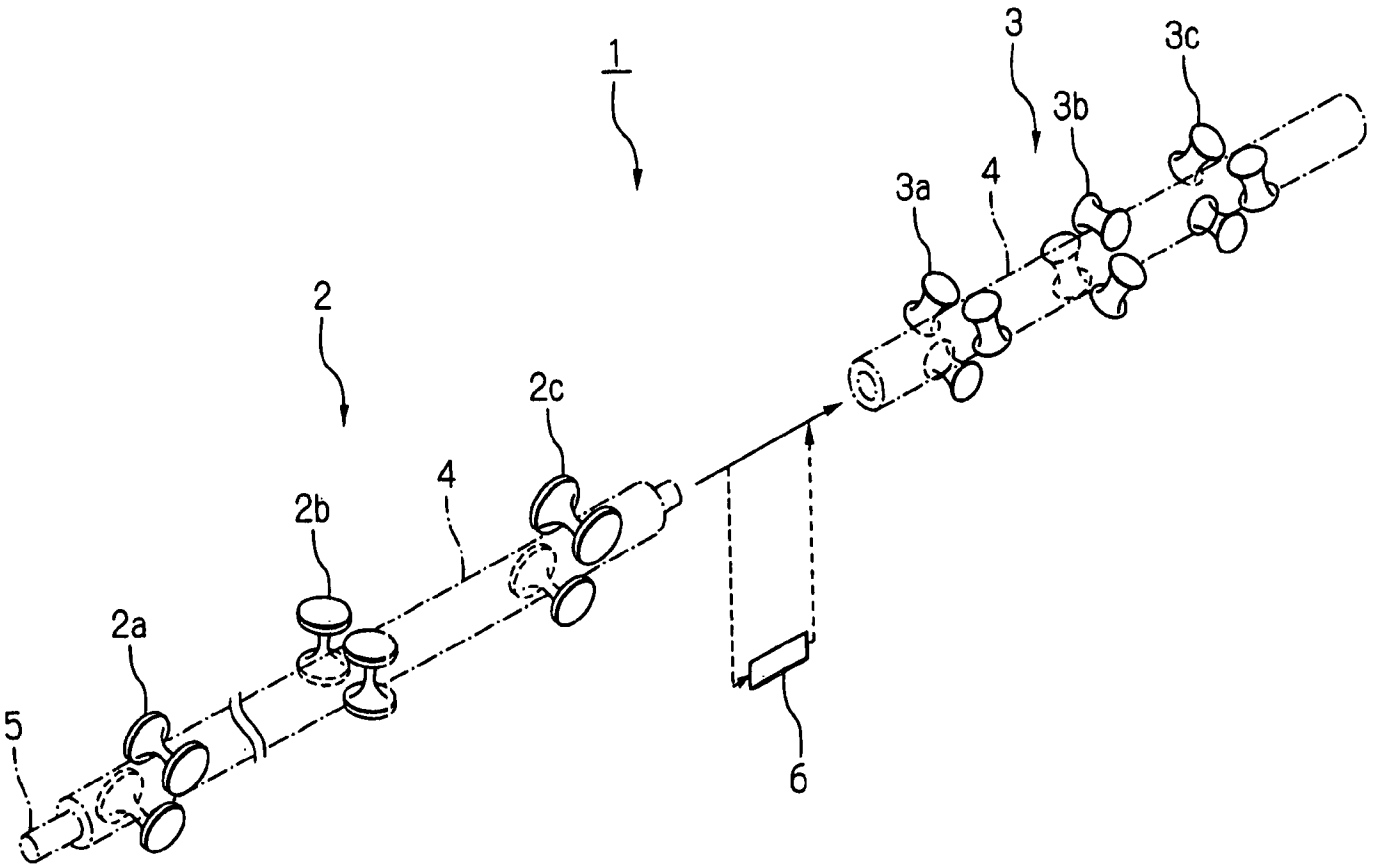
FIG. 1 is a simplified explanatory view showing an example of a conventional manufacturing process for a seamless pipe.

As shown in FIG. 1, elongation rolling is carried out on a mother tube 4 for forming a seamless steel pipe using a mandrel mill 2 having rolling stands 2*a*–2*c* each equipped with two caliber rolls positioned at intervals of 180°. Sizing is then carried out using a sizing mill 3 having rolling stands 3*a*–3*c* each equipped with three caliber rolls positioned at equal intervals of 120° to manufacture a seamless steel pipe. In this mode for carrying out the invention, prior to carrying out elongation rolling, the portions of wall thickness variation where the thickness of the seamless steel pipe at the completion of sizing will locally vary in the circumferential direction are determined. Procedures for determining the portions of wall thickness variation in a seamless steel pipe will be explained.

In this mode for carrying out the invention in which sizing is carried out with a sizing mill 3, portions of wall thickness variation are usually portions of decreased thickness. When sizing is carried out with a stretch reducing mill, there are cases in which the portions of wall thickness variation become increased thickness portions.

The portions of wall thickness variation can be located by measuring the positions of thickness variation and the amount of thickness variation in the resulting seamless steel pipe.

The measurement can be carried out using a γ-ray type thermal thickness gauge positioned at the exit of the sizing mill. Alternatively, the thickness can be determined after cooling the seamless pipe to room temperature using a micrometer or ultrasonic inspection device (thickness can be calculated based on a difference in time between reflections of ultrasonic waves from the outer surface and from the inner surface of the pipe.

Whichever way of measurement employed, it is important to determine the exact interrelation between a position in the circumferential direction during rolling and a position in the circumferential direction while measuring. When the wall thickness is determined using a γ-ray type thermal thickness gauge positioned at the exit of the sizing mill, a circumferential position during rolling substantially conforms to a circumferential position while measuring the wall thickness variations. In contrast, this is not the case when measuring after cooling. In such a case, a hollow shell or mother tube is previously provided with a visible mark (punch-pressed mark, for example) at a certain position in the circumferential direction.

[Elongation Rolling to Cancel the Specified Portions of Wall Thickness Variation]

In this mode for carrying out the invention, it is previously determined where and how large the wall thickness variation is, and elongation rolling is carried out with a mandrel mill 2 such that the thickness of the portions of a mother tube corresponding to the portions of wall thickness variation of the seamless steel pipe is different from the thickness of other portions to cancel the wall thickness variation during sizing.

In this mode for carrying out the invention, elongation rolling with the mandrel mill 2 is carried out with reductions in two directions intersecting at 90°, so the portions of wall thickness variation of the mother tube at the completion of elongation rolling are one or both of a portion including a position at 45° with respect to the direction of reduction or a portion including a position in the direction of reduction of the last two rolling stands which carry out elongation rolling.

When a portion of wall thickness variation of the mother tube is a portion including a position at 45°, measured from the axis of the pipe, with respect to the direction of reduction, elongation rolling is carried out such that the roll gap of rolling stands 2*b* and 2*c* of the mandrel mill 2 which carries out elongation rolling is smaller than a gap at which the shape of the roll grooves becomes a circle, and by using a mandrel bar 5 having an outer diameter smaller than the outer diameter of the mandrel bar 5 which can make the wall thickness a target wall thickness on the exit side of the mandrel mill 2 when the roll gap is such that the shape of the roll grooves is a circle.

When a portion of the mother tube corresponding to the above-described portion of wall thickness variation is a portion including a position in the direction of reduction of the final rolling stand 2*c* which carries out elongation rolling, the roll gap of the final rolling stand 2*c* of the mandrel mill 2 is made larger than the gap which produces a roll groove with a circular shape, the roll gap in the direction of reduction of the preceding rolling stand 2*b* is made smaller than the gap producing a roll groove with a circular shape, and then elongation rolling is performed.

Figure 2A:
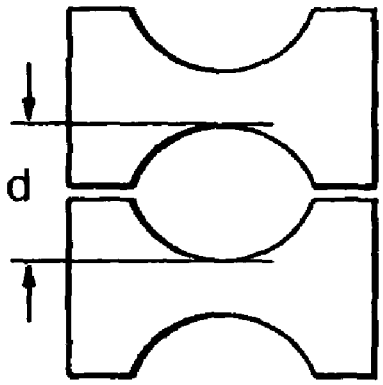
FIG. 2(*a*) is an explanatory view showing the distance between the bottom portions of grooves, and FIG. 2(*b*) is an explanatory view showing the curvature of the bottom portion of a groove.
Figure 2B:
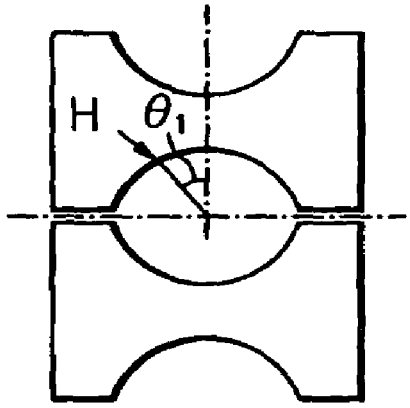

FIG. 2(*a*) is an explanatory view showing the "distance between the bottom portions of the grooves", and FIG. 2(*b*) is an explanatory view showing the "curvature of the bottom portions of the grooves." The "distance between the bottom portions of the grooves" means distance d in FIG. 2(*a*). The "curvature of the bottom portions of the grooves" has the same meaning as the average curvature of the bottom portions of the grooves and is found by $\int_{-(90/n)\times 0.8}^{(90/n)\times 0.8} H(\theta)d\theta/\{(90/n)\times 0.8\times 2\}$. Here, n indicates the number of rolls making up one stand, and H(θ) is the curvature at θ in FIG. 2(*b*). It is defined as $H(\theta)=d\psi(\theta)/ds(\theta)$, wherein $\psi(\theta)=\tan^{-1} dy(\theta)/dx(\theta)$ and $ds(\theta)=(dx^2(\theta)+dy^2(\theta))^{1/2}$.

In an actual mandrel mill 2, the "distance d between the bottom portions of the grooves" and the "curvature of the bottom portions of the grooves $\int_{-(90/n)\times 0.8}^{(90/n)\times 0.8} H(\theta)d\theta/\{(90/n)\times 0.8\times 2\}$" are found by calculations based on the cross sections shown in FIG. 2(*a*) and FIG. 2(*b*) obtained from design drawings for each of the caliber rolls.

Alternatively, they may be found by measuring the dimensions and shape of the bottom portions of the grooves of caliber rolls used in the actual production of a seamless steel pipe. The following is an example of a method which can be used to measure the dimensions and shape of the bottom portion of a groove.

(1) The cross section of a caliber roll is photographed using a digital camera or the like (such as EOS-1D Mark II made by Canon) having at least 5 million pixels.

(2) The photographed image is converted into a bit map image, and image processing such as changing the contrast of the image or converting it to a gray scale is performed using image processing software such as Paint Shop Pro.

(3) A roll groove borderline is extracted from the image processing data, and numerical calculations based on the above-described formulas are performed on the curve which is obtained.

As another method, (1) Using a commercial 3-dimensional coordinate measuring apparatus (such as UPMC-CARAT made by Tokyo Seimitsu), the operating region of a probe is first fixed in a plane which is perpendicular with respect to the rotational axis of the roll, and an x-axis and a y-axis within the plane are determined.

(2) The probe is moved along the roll surface, the point where x has the largest value is searched for, and the operating region of the probe is refixed in a plane including that point, the x-axis, and the roll axis.

(3) A curve of the groove surface is extracted by moving the probe within this plane and along the roll surface along the above-described cross section.

(4) Numerical calculations are carried out with respect to the obtained curve based on the above formula.

In this mode for carrying out the invention, the conditions of elongation rolling by the mandrel mill 2 are adjusted in accordance with the percent of thinning of a portion where the wall thickness of a seamless steel pipe is decreased so that the mother tube 4 on the exit side of the mandrel mill 2 corresponding to this portion is increased in thickness by a prescribed percent.

The amount of increase in thickness which is imparted by the mandrel mill 2 is preferably at least the decrease in wall thickness which is produced in a seamless steel pipe after sizing is carried out by the sizing mill 3. It can be found by multiplying the decrease in thickness by a prescribed multiple $\alpha(>1)$. This multiple can be set to increase as the reduction in the outer diameter produced by sizing in the sizing mill 3 increases. Furthermore, it can be set to increase as the local temperature differences in the mother tube 4 immediately before sizing by the sizing mill 3 increase.

The relationship between the reduction of the outer diameter during sizing and the decrease in wall thickness found at the completion of sizing and the relationship between the increase in wall thickness to be imparted during elongation and the decrease in wall thickness found at the completion of sizing are each linear relationships. If a prescribed measurement is performed and a coefficient is determined, the increase in thickness imparted by the mandrel mill 2 can be quickly and simply determined.

In this manner, in this mode for carrying out the invention, a portion of thickness variation is a portion of decreased thickness, so elongation rolling is carried out so that the thickness of a portion of the mother tube corresponding to a portion of wall thickness variation is larger than that of other portions of the mother tube.

[Sizing]

Under usual conditions, sizing is carried out by a sizing mill 3 on a mother tube which has undergone elongation rolling so that the thickness of a portion of the mother tube corresponding to a portion of thickness variation is larger than the thickness of other portions of the mother tube.

The thickness of the portions of the mother tube 4 corresponding to portions of wall thickness variation becomes greater than the thickness of other portions of the mother tube 4, so the increase in the thickness of the portions of wall thickness variation cancels out the decrease in wall thickness caused for reasons (a)–(c) during sizing by the sizing mill 3. According to this mode for carrying out the present invention, therefore, local variations in the circumferential direction of the wall thickness of a seamless pipe can be easily prevented with certainty.

In this mode for carrying out the invention, by employing the below-described methods (i)–(iv), the amount of increase in wall thickness caused by elongation rolling using the mandrel mill 2 can be decreased, so it is possible to deal with cases in which local increases in wall thickness cannot be adequately achieved by the mandrel mill 2.

(i) After rolling by the mandrel mill 2, the mandrel bar 5 is pulled out of the mother tube as early as possible.

(ii) Elongation rolling conditions are set such that the mandrel bar 5 does not contact the inner surface of the mother tube 4 after rolling by the mandrel mill 2.

(iii) The reduction in outer diameter by the sizing mill 3 is set to be as small as possible.

(iv) After rolling by the mandrel mill 2, the mother tube 4 is heated in a heating furnace.

As explained above, by forming a mother tube 4 which is previously increased in thickness in portions where the temperature necessarily decreases for reasons (a)–(c) during elongation rolling using a mandrel mill 2 and by carrying out sizing using a sizing mill 3, the amount of thickness variation can be suppressed to a level which can satisfy a prescribed standard which is allowable for a product.

Instead of the above-described mode for carrying out the invention, the below-described means (v)–(ix) may be used.

(v) The position and amount of thickness variations of a manufactured seamless steel pipe are measured, and using this information, the roll gap of the mandrel mill 2 is adjusted by feedback control. This control may be automated online.

(vi) The temperature distribution of the mother tube 4 on the exit side of the mandrel mill 2 and of the steel pipe on the exit side of the sizing mill 3 are measured, the position and the amount of thickness variations occurring after sizing are estimated, and based on this estimate, the roll gap of the mandrel mill 2 is adjusted by feedback control.

(vii) If necessary, the temperature of the mandrel bar 4 may be adjusted by passing it through a heating furnace.

(viii) The gaps of not only the last two rolling stands 2*b* and 2*c* of the mandrel mill 2 which forms thickness variations but also of the rolling stands upstream of these rolling stands 2*b* and 2*c* are adjusted to obtain a balance over the entire elongation rolling process.

(ix) If the relationship among the amount of increase in the thickness of the mother tube 4 on the exit side of the mandrel mill 2, the amount of reduction in the outer diameter and the like in the sizing mill 3, and the amount of thickness variation in the seamless steel pipe product is determined in advance, the resulting relationship may be expressed in a table or by a regression formula, and the table or regression formula may be stored in a computer or the like. Manufacturing conditions may be determined using manufacturing conditions obtained from a host computer and the table or the regression formula. When rolling is carried out under these manufacturing conditions, it is possible to manufacture a high precision product from the start of rolling. If feedback of the results of rolling is performed and the table or the regression formula is corrected, a higher precision product can be manufactured.

EXAMPLES

Example 1

In this example, the present invention is applied to a case in which four thin portions caused for reason (b) are formed in a seamless steel pipe at the completion of sizing. The positions of the four thin portions are at 45°, measured from the axis of the pipe, with respect to the direction of reduction of elongation rolling.

Figure 3:
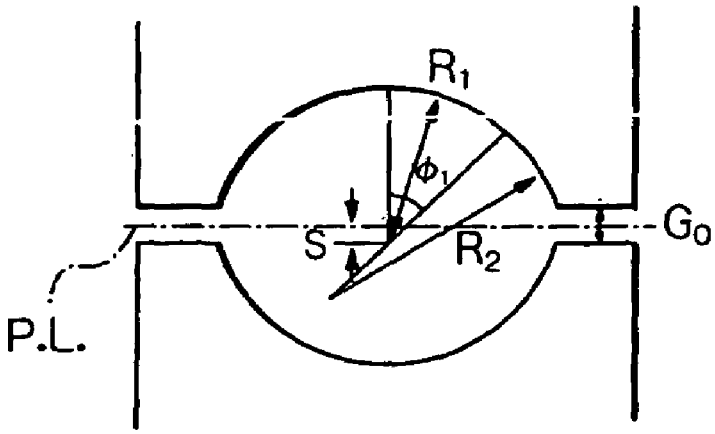
FIG. 3 is an explanatory view schematically showing the groove shape for the last two rolling stands of the mandrel mill used in Example 1.

A seamless steel pipe was manufactured under the following conditions. FIG. 3 schematically illustrates the shape of the grooves in the last two rolling stands of the mandrel mill.

(1) Material Being Treated

Dimensions of final product: Outer diameter of 245 mm, wall thickness of 12 mm

Material: carbon steel (2) Pipe Manufacturing Process

Heating furnace→piercing mill→mandrel mill→extracting sizing mill (3) Dimensions of the Grooves of the Last Two Rolling Stands of the Mandrel Mill Offset S=0 mm $R_1$=150 mm $_1$=45°

Baseline gap of the mandrel mill such that the shape of the grooves is a circle $G_0$=50 mm (4) Evaluation Method The percent of local thinning of the wall thickness of the final product was found in the following manner.

Percent local thinning of the wall thickness of the final product=(wall thickness of the locally thinned portion−average wall thickness of the final product)/average wall thickness of the final product×100 (%)

(5) Detailed Conditions

Detailed conditions are summarized in Table 1.

TABLE 1

| | Mandrel bar diameter | Mandrel mill gap $G_0$ | Mandrel mill outer diameter | Mother tube wall thickness | Increase in wall thickness of locally thinned portion of mother tube |
|---|---|---|---|---|---|
| Conventional Method A | 278.0 mm | 50.0 mm | 300 mm | 11 mm | 0.0 mm |
| Method A of the Present Invention | 276.2 mm | 47.9 mm | 298 mm | 11 mm | 0.3 mm |
| Method B of the Present Invention | 275.6 mm | 47.2 mm | 297 mm | 11 mm | 0.4 mm |

| | Curvature of bottom of groove | Distance between bottoms of grooves | Two times inverse of distance between bottoms of grooves |
|---|---|---|---|
| Conventional Method A | 1/150($mm^{-1}$) | 300 mm | 1/150($mm^{-1}$) |
| Method A of the Present Invention | 1/150($mm^{-1}$) | 298 mm | 1/149($mm^{-1}$) |
| Method B of the Present Invention | 1/150($mm^{-1}$) | 297 mm | 1/148.5($mm^{-1}$) |

In this example, Conventional Method A is a method in which rolling is performed with the roll gap in the direction of reduction of the rolling stand set to a position such that the shape of the roll groove is a circle. Method A of the present invention is a method in which rolling is carried out with the roll gap in the direction of reduction of the rolling stand decreased by 2.1 mm from the gap at which the shape of the roll groove is a circle. Method B of the present invention is a method in which rolling is carried out with the gap in the direction of reduction of the rolling stand decreased by 2.8 mm from the gap at which the shape of the groove is a circle.

As a result, with Conventional Method A, when 423 pipes were manufactured, the percent of local thinning of the wall thickness of the final product was 2.50% (0.3 mm).

In contrast, in Method A of the present invention, portions which underwent thinning were increased in thickness. When 95 pipes were manufactured, the percent of local thinning of the wall thickness of the final product was suppressed to 1.00% (0.12 mm).

In Method B of the present invention the wall thickness was increased by more than the amount of thinning. When 218 pipes were manufactured, the percent of local thinning of the wall thickness of the final product was 0.15% (0.02 mm).

Example 2

In this example, the present invention is applied to a case in which two thin portions caused for the reasons (a) and (c) are formed in a seamless steel pipe at the completion of sizing. The positions of the two thin portions are in the direction of elongation rolling in the final stand as viewed from the center of the pipe.

Using the below-described three conditions I–III, seamless steel pipes were manufactured.

Condition I: After heating at 1000° C., a hollow shell measuring 320 mm in diameter, 30 mm thick, and 6000 mm long was subjected to elongation rolling using a 5-stand mandrel mill to a diameter of 270 mm and a thickness of 15 mm. After elongation rolling, sizing was carried out using a sizing mill without any reheating.

Condition II: After heating at 1000° C., a hollow shell measuring 320 mm in diameter, 30 mm thick, and 6000 mm long was subjected to elongation rolling using a 5-stand mandrel mill to obtain a diameter of 270 mm and a thickness of 15 mm. It was then left in a reheating furnace (950° C.) for 5 minutes, and then sizing was carried out with a sizing mill.

Condition III: After heating at 1000° C., a hollow shell measuring 320 mm in diameter, 30 mm thick, and 6000 mm long was subjected to elongation rolling to a diameter of 270 mm and a thickness of 15 mm using a 6-stand mandrel mill. Sizing was then carried out using a sizing mill without any reheating.

The results are compiled in Table 2.

The thickness variation imparted by mandrel mill in Table 2 means a roll gap expanded apart from the baseline position at which the shape of the roll hole is a circle for the final stand, and also means a roll gap reduced from the baseline position at which the shape of the roll hole is a circle for the roll stand before the final stand.

TABLE 2

| Conditions | Controlling method: Thickness variation (mm) imparted by mandrel mill | Controlling method: Feedback control | Rolling Conditions and Effects: Outer diameter reduction ratio (%) | Thickness variation (%): Condition I | Thickness variation (%): Condition II | Thickness variation (%): Condition III |
|---|---|---|---|---|---|---|
| Example C | 0.33 | No | 20 | 0.3 | 0.3 | 0.2 |
| Example D | 0.50 | | 30 | 0.7 | 0.4 | 0.5 |
| Example E | 0.34 | | 20 | 0.2 | 0.1 | 0.3 |
| Example F | 0.39 | | 30 | 0.2 | 0.1 | 0.1 |
| Example G | 0.50 | Yes | 30 | 0.0 | 0.0 | 0.0 |
| Comparative Example | 0.00 | No | 20 | 3.4 | 2.0 | 2.5 |

The percent of wall thickness variation was defined by the following formula:

{(Wall thickness of product (average of two locations) at the bottom of the groove of an odd numbered stand of the mandrel mill−wall thickness of product (average of two locations) at the bottom of the groove of an even numbered stand of the mandrel mill)/average wall thickness of product}×100 (%)

Feedback control was carried out such that the average was determined of the difference between the wall thickness at the bottom of the grooves for the last stand and the wall thickness at the bottom of the grooves for the preceding stand for the last 10 pipes at the time of rolling using the same steel pipe of the same steel and dimensions, and the wall thickness at the bottom of the grooves of the final stand and the wall thickness of the bottom of the groove of the preceding stand were adjusted by ½ of the negative of the average. The case is also shown in which the thickness variation control amount was changed.

The wall thickness variations are reduced by means of providing a thick portion during elongation rolling. Under condition I in which the wall thickness variations are easily formed, the wall thickness variations are markedly reduced by the application of the method of the present invention. It is to be noted that in Example G in which a feedback control method is applied together with the method of the present invention, the formation of wall thickness variations was completely prevented.

As shown in Example I of Table 3, when not only the final two stands but also the preceding two stands are varied with respect to the amount of reduction in the same manner, the formation of flaws can successfully be prevented.

TABLE 3

| Conditions | Adjustment of roll gap of preceding stands | Rate of occurrence of flaws (%) |
|---|---|---|
| Example H | No | 2 |
| Example I | Yes | 0 |

These results can be obtained not only with a two-roll mandrel mill but with a three-roll mandrel mill or with a four-roll mandrel mill.

Alternative Modes

In the above explanation, an example was given of the case in which the seamless pipe is a seamless steel pipe. However, the present invention is not limited to a seamless steel pipe, and it can be applied in the same manner to a seamless metal pipe other than a seamless steel pipe.

In the above explanation of the first mode for carrying out the invention, an example was given of the case in which sizing was carried out using a rolling stand with three caliber rolls disposed at intervals of 120°. However, the present invention is not limited to a mode in which sizing is carried out using a sizing mill, and it can be applied in the same manner to the case in which sizing is carried out using a stretch reducing mill. In addition, the number of rolls of a sizing mill is not limited to three and may be two.

If sizing is carried out using a stretch reducing mill, depending on the conditions, there are cases in which the wall thickness of a mother tube is decreased. In cases in which the wall thickness is decreased, the amount of decrease in wall thickness is smaller in portions where the temperature is low, so in this mode for carrying out the invention, these portions can be reduced in thickness in the mandrel mill, which is the opposite of the first mode for carrying out the invention.

INDUSTRIAL APPLICABILITY

According to the present invention, a seamless pipe can be manufactured while preventing local variations in wall thickness in the circumferential direction.

The invention claimed is:

1. A process for manufacturing a seamless steel pipe, which comprises the steps of:

preparing a mother tube;

performing elongation rolling of the mother tube using a mandrel mill comprising a plurality of roll stands each having caliber rolls to form wall thickness variations in the circumferential direction of the mother tube; the position and amount of the wall thickness variations being predetermined in view of wall thickness variations to be formed in the circumferential direction of a seamless steel pipe during roll sizing, and performing roll sizing of the resulting mother tube from the elongation rolling to cancel the wall thickness variations formed during the elongation rolling, characterized in that (i) the wall thickness variation of the seamless pipe are portions where the wall thickness is decreased, (ii) the wall thickness variation is located in the circumferential direction of the mother tube at a position of around 45° with respect to the direction of reduction of the final roll stand of the elongation rolling, and (iii) the elongation rolling is carried our by reducing the roll gap of the mandrel mill smaller than a roll gap at which the shape of the grooves is a circle, and using a mandrel bar having a smaller outer diameter than the outer diameter of a mandrel bar with which a target wall thickness can be obtained at the exit of the mandrel mill when the roll gap is so adjusted that the shape of the groove is a circle.

2. The process of claim 1, wherein the wall thickness variations to be formed during roll sizing is determined in view of rolling conditions of roll sizing.

3. The process of claim 2, wherein the rolling conditions include temperature variations in the circumferential direction of the mother tube.

4. A process for manufacturing a seamless steel pipe, which comprises the steps of:

preparing a mother tube;

performing elongation rolling of the mother tube using a mandrel mill comprising a plurality of roll stands each having caliber rolls to form wall thickness variations in the circumferential direction of the mother tube; the position and amount of the wall thickness variations being predetermined in view of wall thickness variations to be formed in the circumferential direction of a seamless steel pipe during roll sizing, and performing roll sizing of the resulting mother tube from the elongation rolling to cancel the wall thickness variations, characterized in that (i) the wall thickness variation of the seamless pipe are portions where the wall thickness is decreased, (ii) the wall thickness variations are located in the circumferential direction of the mother tube at a position in the direction of reduction of the final roll stand of the elongation rolling, and (iii) the elongation rolling is carried out by increasing the roll gap of the final rolling stand of the mandrel mill larger than a roll gap at which the shape of the grooves of the caliber rolls is a circle, and by decreasing the roll gap in the direction of reduction of the preceding roll stand with respect to a roll gap at which the shape of the grooves is a circle.

5. The process of claim 4, wherein the wall thickness variations to be formed during roll sizing is determined in view of rolling conditions of roll sizing.

6. The process of claim 5, wherein the rolling conditions include temperature variations in the circumferential direction of the mother tube.

* * * * *